United States Patent [19]

Tanaka et al.

[11] Patent Number: 4,973,573

[45] Date of Patent: Nov. 27, 1990

[54] THERMAL TRANSFER DYE-PROVIDING MATERIAL

[75] Inventors: Mitsugu Tanaka; Seiiti Kubodera; Hisashi Mikoshiba, all of Kanagawa, Japan

[73] Assignee: Fuji Photo Film Co., Ltd., Kanagawa, Japan

[21] Appl. No.: 476,850

[22] Filed: Feb. 7, 1990

[30] Foreign Application Priority Data

Feb. 8, 1989 [JP] Japan ..... 1-29419

[51] Int. Cl.[5] ..... B41M 5/035; B41M 5/26

[52] U.S. Cl. ..... 503/227; 8/471; 428/195; 428/484; 428/913; 428/914

[58] Field of Search ..... 8/471; 428/195, 913, 428/914, 484, 488.1; 503/227

*Primary Examiner*—Bruce H. Hess

*Attorney, Agent, or Firm*—Sughrue, Mion, Zinn, Macpeak and Seas

[57] ABSTRACT

A thermal transfer dye-providing material is disclosed, which comprises a support having provided thereon a colorant layer, said colorant layer containing a dye represented by the following general formula (I):

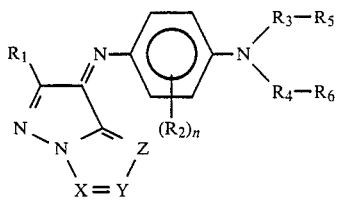

(I)

wherein $R_1$ and $R_2$ each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group or an amino group, $R_3$ $R_4$ each represents an alkylene group, $R_5$ represents a halogen atom, an alkoxycarbonyl group, an alkoxycarbonyloxy group, a cyano group, an alkoxycarbonylamino group, a ureido group, a carbamoyl group, a sulfonyl group, an acyloxy group or an acyl group, $R_6$ represents a hydrogen atom or $R_5$, n represents 0 or an integer of 1 to 3, and X, Y and Z each represents

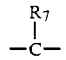

or a nitrogen atom (wherein $R_7$ represents a hydrogen atom, an alkyl group, a cycloalkyl group, an aralkyl group, an aryl group, an alkoxy group, an aryloxy group or an amino group) or, when X and Y, or Y and Z, are

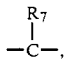

they may be bound to each other to form a saturated or unsaturated hydrocarbon ring, with the above-described substituents being optionally further substituted.

9 Claims, No Drawings

THERMAL TRANSFER DYE-PROVIDING MATERIAL

FIELD OF THE INVENTION

The present invention relates to a thermal transfer material.

BACKGROUND OF THE INVENTION

The thermal transfer process, electrophotographic process, ink jet process, etc. are at present being vigorously investigated as processes relating to formation of color hard copies. Thermal transfer dye-providing processes are more advantageous in many points than other processes since maintainance and operation of the apparatus adapted for the process are simple and the apparatus and expendables therefor are less expensive.

The thermal transfer process involves heating by means of a thermal head a thermal transfer dye-providing material comprising a base film having formed thereon a heat-meltable ink layer to thereby melt said ink and transfer said molten ink to a thermal transfer image-receiving material or heating by means of a thermal head a thermal transfer dye-providing material comprising a base film having formed thereon a colorant layer containing a thermally transferrable dye to thereby allow the dye to migrate and transfer to a thermal transfer image-receiving material. Of the two types, the latter thermal migration transfer type is advantageous particularly for full-color recording with high image quality, because the dye can be transferred to a different layer by changing the energy applied to the thermal head, which facilitates gradation recording.

However, the thermally transferrable dyes for use in the latter type thermal transfer process are required to possess various properties, and extremely few dyes satisfy all of the requirements.

Requirements for the dyes involve, for example, to possess spectral properties favorable for color reproduction, to easily migrate, to be resistant against light and heat, to be resistant against various chemicals, not to undergo reduction in sharpness, not to cause re-transfer of a transfer image, to be easily synthesized, and to facilitate preparation of thermal transfer dye-providing materials. Magenta dyes with spectral properties favorable for color reproduction (particularly a sharp absorption waveform) and excellent light fastness have been desired.

There have been proposed various types of thermal transfer process magenta dyes. For example, anthraquinone series magenta dyes are disclosed in JP-A-60-131293 (the term "JP-A" as used herein means an "unexamined published Japanese patent application"), JP-A-60-159091, JP-A-61-227093 and JP-A-61-262190 and azo series magenta dyes are disclosed in JP-A-60-30391, JP-A-60-30392, JP-A-60-30394, JP-A-61-227091 and JP-A-61-227092. However, these dyes do not have both excellent spectral properties (particularly a sharp absorption waveform) and light fastness.

SUMMARY OF THE INVENTION

An object of the present invention is to provide a thermal transfer dye-providing material containing a magenta dye overcoming the above-described defects.

This and other objects of the present invention will become apparent from the following description thereof.

The above-described and other objects of the present invention are attained by a thermal transfer dye-providing material comprising a support having provided thereon a colorant layer containing a dye represented by the following general formula (I):

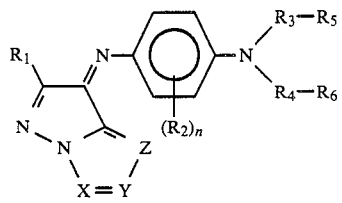

(I)

wherein $R_1$ and $R_2$ each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group or an amino group, $R_3$ and $R_4$ each represents an alkylene group, $R_5$ represents a halogen atom, an alkoxycarbonyl group, an alkoxycarbonyloxy group, a cyano group, an alkoxycarbonylamino group, a ureido group, a carbamoyl group, a sulfonyl group, an acyloxy group or an acyl group, $R_6$ represents a hydrogen atom or $R_5$, n represents,0 or an integer of 1 to 3, and X, Y and Z each represents

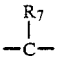

or a nitrogen atom (wherein $R_7$ represents a hydrogen atom, an alkyl group, a cycloalkyl group, an aralkyl group, an aryl group, an alkoxy group, an aryloxy group or an amino group) or, when X and Y, or Y and Z, are

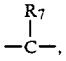

they may be bound to each other to form a saturated or unsaturated hydrocarbon ring, with the above-described substituents being optionally further substituted.

DETAILED DESCRIPTION OF THE INVENTION

The general formula (I) described in more detail below.

$R_1$ and $R_2$ each represents a hydrogen atom, a halogen atom (e.g., fluorine, chlorine or bromine), an alkyl group (containing preferably 1 to 12 carbon atoms; e.g., methyl, ethyl, butyl, isopropyl, t-butyl, hydroxyethyl, methoxyethyl, cyanoethyl or trifluoromethyl), a cycloalkyl group (preferably 5- or 6-membered cycloalkyl group; e.g., cyclopentyl or cyclohexyl), an alkoxy group (containing preferably 1 to 12 carbon atoms; e.g., methoxy, ethoxy, isopropoxy, methoxyethoxy or hydroxyethoxy), an aryl group (containing preferably 6 to 15 carbon atoms; e.g., phenyl, p-tolyl, p-methoxyphenyl, p-chlorophenyl or o-methoxyphenyl), an aryloxy group (containing preferably 6 to 15 carbon atoms; e.g., phenoxy, p-methylphenoxy, p-methoxyphenoxy or o-methoxyphenoxy), an aralkyl group (containing preferably 7 to 16 carbon atoms; e.g., benzyl or 1-phenethyl), a cyano group, an acylamino group (wherein the acyl moiety preferably contains 2 to 12 carbon atoms; e.g., acetylamino, propionylamino or isobutyroylamino), a sulfonylamino group (e.g., methanesulfonylamino, benzenesulfonylamino or trifluoromethanesulfonylamino), a ureido group (containing preferably 2 to 10 carbon atoms; e.g., 3-methylureido, 3,3-dimethylureido or 1,3-dimethylureido), an alkoxycarbonylamino group (containing preferably 2 to 10 carbon atoms; e.g., methoxycarbonylamino, ethoxycarbonylamino or butoxycarbonylamino), an alkylthio group (containing preferably 1 to 12 carbon atoms; e.g., methylthio or butylthio), an arylthio group (containing preferably 6 to 15 carbon atoms; e.g., phenylthio or p-tolylthio), an alkoxycarbonyl group (containing preferably 2 to 12 carbon atoms; e.g., methoxycarbonyl or ethoxycarbonyl), a carbamoyl group (containing preferably 2 to 12 carbon atoms; e.g., methylcarbamoyl or dimethylcarbamoyl), a sulfamoyl group (containing preferably 1 to 12 carbon atoms; e.g., dimethylsulfamoyl or diethylsulfamoyl), a sulfonyl group (containing preferably 1 to 12 carbon atoms; e.g., methanesulfonyl, butanesulfonyl or phenylsulfonyl), an acyl group (containing preferably 1 to 12 carbon atoms; e.g., acetyl or butyroyl), or an amino group (containing preferably 0 to 12 carbon atoms; e.g., methylamino or dimethylamino).

Of these, an alkyl group containing up to 8 carbon atoms, an alkoxy group containing up to 8 carbon atoms, and an aryl group containing 6 to 12 carbon atoms are particularly preferable as $R_1$, and a hydrogen atom, an alkyl group containing up to 4 carbon atoms, an alkoxy group containing up to 4 carbon atoms, a halogen atom, an acylamino group containing up to 7 carbon atoms, and an alkoxycarbonylamino group containing up to 7 carbon atoms are particularly preferable as $R_2$, with the proviso that, in this case, $R_2$ is in an o-position with respect to the azomethine bond and $n=1$.

$R_3$ and $R_4$ each represents an alkylene group (containing preferably 1 to 8 carbon atoms; e.g., methylene, ethylene, isopropylene or cyclohexylene). Of these, ethylene is particularly preferable as $R_3$ and $R_4$.

$R_5$ represents a halogen atom (e.g., chlorine), an alkoxycarbonyl group (containing preferably 2 to 8 carbon atoms; e.g., methoxycarbonyl or ethoxycarbonyl), an alkoxycarbonyloxy group (containing preferably 2 to 8 carbon atoms; e.g., methoxycarbonyloxy or ethoxycarbonyloxy), a cyano group, an alkoxycarbonylamino group (containing preferably 2 to 8 carbon atoms; e.g., methoxycarbonylamino or ethoxycarbonylamino), a ureido group (containing preferably 2 to 8 carbon atoms; e.g., 3-methylureido or 3,3-dimethylureido), a carbamoyl group (containing preferably 2 to 8 carbon atoms; e.g., methylcarbamoyl, dimethylcarbamoyl or butylcarbamoyl), a sulfonyl group (containing preferably 1 to 7 carbon atoms; e.g., methylsulfonyl or ethylsulfonyl), an acyloxy group (containing preferably 2 to 8 carbon atoms; e.g., acetyloxy, propionyloxy, isobutyroyloxy or benzoyloxy) or an acyl group (containing preferably 2 to 8 carbon atoms; e.g., acetyl).

Particularly preferable examples of $R_5$ are a cyano group, a sulfonyl group, an alkoxycarbonyl group containing 2 to 5 carbon atoms, and an acyloxycarbonyl group containing 2 to 5 carbon atoms.

$R_6$ represents a hydrogen atom or $R_5$ (the same as defined above).

$R_6$ preferably represents a hydrogen atom.

X, Y and Z each represents $$-\overset{\overset{R_7}{|}}{C}-$$

or a nitrogen atom (wherein $R_7$ represents a hydrogen atom, an alkyl group, a cycloalkyl group, an aralkyl group, an aryl group, an alkoxy group, an aryloxy group or an amino group), with examples of these substituents being those illustrated with respect to $R_1$ and $R_2$;

Preferably, each of X, Y and Z represents a nitrogen atom, two of X, Y and Z represent nitrogen atoms, or only one of X, Y and Z represents a nitrogen atom and, more preferred, each of X, Y and Z represents a nitrogen atom, or two of X, Y and Z represent nitrogen atoms.

Preferred specific examples of the dyes of the above general formula (I) to be used in the present invention are illustrated below which, however, are not limitative at all.

| Dye No. | $-R_1$ | $-R_2$ | $-R_3-R_5$ | $-R_4-R_6$ | $-R_7$ |
|---|---|---|---|---|---|
| | 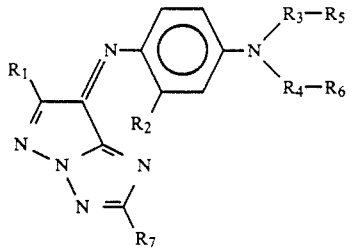 | | | | |
| 1 | 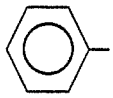 | H | $-CH_2CH_2CN$ | $-C_2H_5$ | $-CH_3$ |

-continued

| Dye No. | $-R_1$ | $-R_2$ | $-R_3-R_5$ | $-R_4-R_6$ | $-R_7$ |
|---|---|---|---|---|---|
| 2 | $(CH_3)_3C-$ | " | " | " | 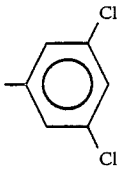 |
| 3 | $-CH_3$ | " | " | " | " |
| 4 | " | $-CH_3$ | " | " | $-CH_3$ |
| 5 | " | H | " | " | " |
| 6 | " | " | $-CH_2CH_2COOC_2H_5$ | " | $-CH(CH_3)-CH_2NHCOCH_3$ |
| 7 | $-CH_3$ | H | $-CH_2CH_2OCOCH_3$ | $-C_2H_5$ | $-CH(CH_3)-CH_2NHCOC_2H_5$ |
| 8 | " | $-CH_3$ | " | $-C_3H_7$ | $-C(CH_3)_3$ |
| 9 | $(CH_3)_3C-$ | " | $-CH_2CH_2CN$ | $-C_2H_5$ | 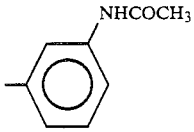 |
| 10 | " | " | " | " | 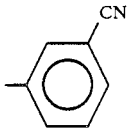 |
| 11 | " | H | $-CH_2CH_2SO_2CH_3$ | " | 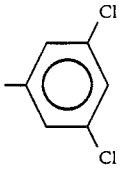 |
| 12 | $-CH_3$ | $-NHCOCH_3$ | $-CH_2CH_2CN$ | " | $-C_2H_5$ |
| 13 | " | $-NHCOOCH_3$ | " | " | $-CH(CH_3)_2$ |
| 14 | " | $-CH_3$ | $-CH_2CH_2OCOC_2H_5$ | $-CH_2CH_2OCOC_2H_5$ | 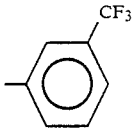 |
| 15 | 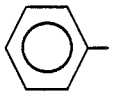 | H | $-CH_2CH_2CN$ | $-C_2H_5$ | 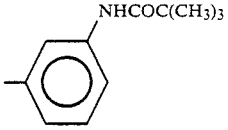 |
| 16 | $-CH_3$ | $-CH_3$ | $-CH_2COOC_2H_5$ | " | 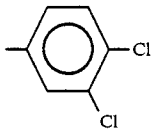 |
| 17 | " | " | $-CH_2CH_2Cl$ | " | " |
| 18 | $C_2H_5O-$ | " | $-CH_2CH_2CONHC_2H_5$ | " | $-CH_2CH_2NHSO_2CH_3$ |
| 19 | 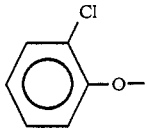 | H | $-CH_2CH_2OCOCH_3$ | $-C_4H_9$ | 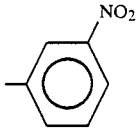 |

-continued

| Dye No. | $-R_1$ | $-R_2$ | $-R_3-R_5$ | $-R_4-R_6$ | $-R_7$ |
|---|---|---|---|---|---|
| | | | 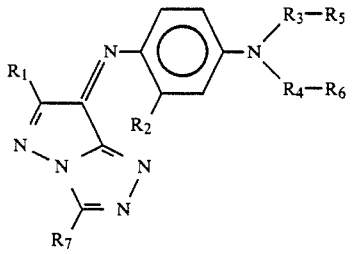 | | |
| 20 | $-CH_3$ | $-CH_3$ | $-CH_2CH_2CN$ | $-C_2H_5$ | $-CH_3$ |
| 21 | $-CH(CH_3)_2$ | " | $-CH_2CH_2OCOC_2H_5$ | " | " |
| 22 | $-CH_3$ | " | $-CH_2CH_2COOC_2H_5$ | $-C_3H_7$ | $-CH_2CH_2SO_2CH_3$ |
| 23 | " | H | " | $-C_2H_5$ | 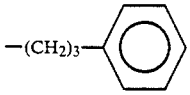 |
| 24 | " | $-CH_3$ | $-CH_2CH_2OCOC_2H_5$ | " | $-CH_2CH_2OCH_3$ |
| 25 | $-CH(CH_3)_2$ | " | $-CH_2CH_2CN$ | " | $-CH_2CH_2SO_2CH_3$ |
| | | | 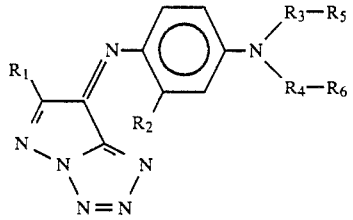 | | |
| 26 | $-CH_3$ | H | $-CH_2CH_2OCOC_2H_5$ | $-C_2H_5$ | |
| 27 | " | $-CH_3$ | $-CH_2CH_2CN$ | $-CH_3$ | |
| 28 | " | H | $-CH_2CH_2COOCH_3$ | $-C_2H_5$ | |
| 29 | $-CH(CH_3)_2$ | " | " | " | |
| 30 | $-C(CH_3)_3$ | " | " | " | |
| 31 | 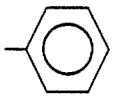 | " | $-CH_2CH_2CN$ | " | |
| | | | 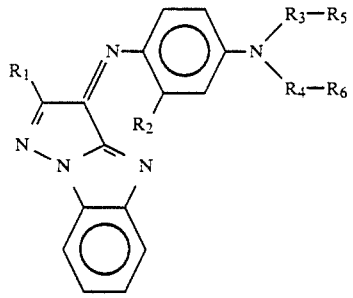 | | |
| 32 | $-CH_3$ | $CH_3$ | $-CH_2CH_2OCOC_2H_5$ | $-C_2H_5$ | |
| 33 | $-C(CH_3)_3$ | " | $-CH_2CH_2COOC_2H_5$ | " | |
| 34 | 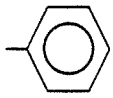 | " | $-CH_2CH_2CN$ | " | |
| 35 | 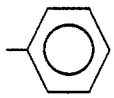 | H | $-CH_2CH_2COOC_3H_7$ | " | |

-continued

| Dye No. | $-R_1$ | $-R_2$ | $-R_3-R_5$ | $-R_4-R_6$ | $-R_7$ |
|---|---|---|---|---|---|
| 36 | $-OC_2H_5$ | $-CH_3$ | " | " | |
| 37 | 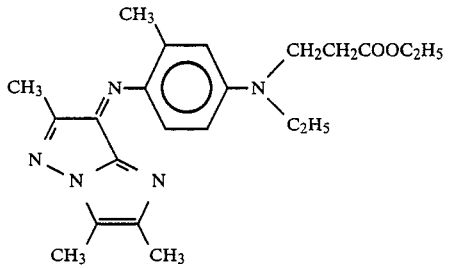 | | | | |
| 38 | 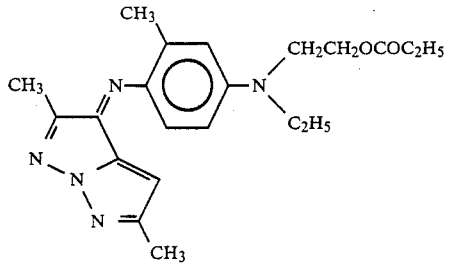 | | | | |
| 39 | 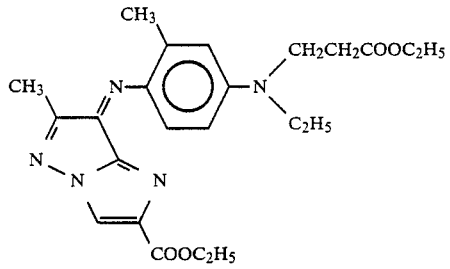 | | | | |

Processes for synthesizing the dyes of the present invention represented by the general formula (I) are described below.

Dyes represented by the general formula (I) can be obtained by oxidative coupling between a fused ring pyrazole derivative represented by the general formula (II) and a p-phenylenediamine derivative represented by the general formula (III) or by dehydration condensation reaction between a pyrazole derivative represented by the general formula (II') and a nitroso compound represented by the general formula (IV).

Scheme 1:

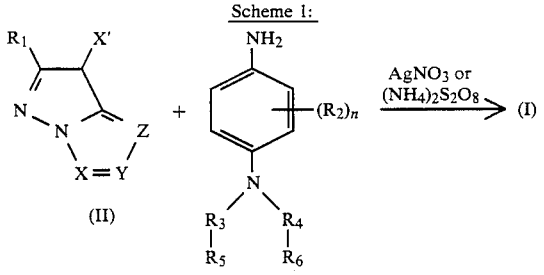

(II) (III)

(X': H or eliminating group)

Scheme 2:

-continued

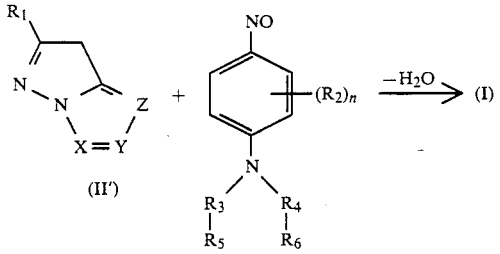

(II') (IV)

The fused ring pyrazole derivative of the general formula (II) or (II') may be synthesized according to various processes.

For example, 1H-pyrazolo[1,5b][1,2,4]triazoles of the following general formula (V) can be easily synthesized according to the process described in, for example, JP-A-61-261738 (corresponding to U.S. Pat. No. 4,721,667).

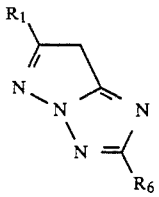

(V)

Reaction between compound (V) and (III) or (IV) proceeds under mild conditions, and gives a dye of the general formula (I) in high yield.

SYNTHESIS EXAMPLE Synthesis of dye No. 1

0.7 g of the compound represented by the following structural formula (A), 100 ml of ethyl acetate and 50 ml of ethanol were mixed at room temperature. To this were added, successively, a solution of 1.1 g of the compound represented by the following structural formula (B) dissolved in 50 ml of water, a solution of 5.3 g of sodium carbonate dissolved in 50 ml of water, and a solution of 1.8 g of ammonium persulfate dissolved in 15 ml of water, and the reaction was conducted for 30 minutes. After liquid separation, the ethyl acetate layer was washed twice with water. After distilling off ethyl acetate, crystallization from methanol yielded 0.7 g of the end product having a melting point of 184° to 185° C.

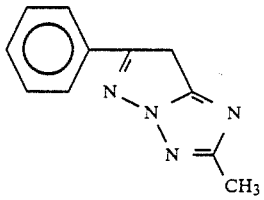

(A)

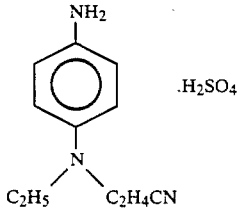

(B)

As is described above, the thermal transfer dye-providing material of the present invention is mainly characterized in the use of a particular dye. In one embodiment thereof, the thermal transfer dye-providing layer containing the above-described dye is a thermal transfer dye-providing layer comprising the thermally transferable dye and a binder resin. The thermal transfer dye-providing material of this embodiment of the present invention can be obtained by dissolving or dispersing the dye of the present invention and the binder resin in a proper solvent to prepare a coating solution, coating this coating solution on one side of a support in a dry thickness of, for example, about 0.2 to 5.0 μm, preferably 0.4 to 2.0 μm, and drying the coated layer to form a thermal transfer dye-providing layer.

As the binder resin to be used together with the dye, any of conventionally known resins for such purpose may be employed. Usually, those which have a high heat resistance and which, when heated, do not inhibit migration of the dye are selected. For example, there may be used a polyamide series resin, a polyester series resin, an epoxy resin, a polyurethane series resin, a polyacrylic resin (e.g., polymethyl methacrylate or polyacrylamide), a vinyl series resin including polyvinylpyrrolidone, a polyvinyl chloride series resin (e.g., vinyl chloride-vinyl acetate copolymer), a polycarbonate series resin, polysulfone, polyphenylene oxide, a cellulose series resin (e.g., methylcellulose, ethylcellulose, carboxymethylcellulose, cellulose acetate hydrogen phthalate, cellulose acetate, cellulose acetate propionate, cellulose acetate butyrate or cellulose triacetate), a polyvinyl alcohol series resin (e.g., polyvinyl alcohol or partially saponified polyvinyl alcohol such as polyvinylbutyral), a petroleum series resin, a rosin derivative, a coumarone-indene resin, a terpene series resin, a novolak type phenol series resin, a polystyrene series resin, and a polyolefinic resin (e.g., polyethylene or polypropylene).

These binder resins are used in an amount of, preferably, about 80 to about 600 parts by weight per 100 parts by weight of the dye.

As a solvent for dissolving or dispersing the above-described dye and the binder resin, conventionally known ink solvents can be used with no limitations. Specifically, there are illustrated water, an alcohol such as methanol, ethanol, isopropyl alcohol, butanol or isobutanol, an ester such as ethyl acetate or butyl acetate, a ketone such as methyl ethyl ketone, methyl isobutyl ketone or cyclohexanone, an aromatic solvent such as toluene, xylene or chlorobenzene, a halogen-containing solvent such as dichloromethane, trichloroethane or chloroform, N,N-dimethylformamide, N-methylpyrrolidone, dioxane, tetrahydrofuran, a cellosolve series solvent such as methylcellosolve or ethyl cellosolve, and a mixture of the above-described solvents. It is of importance to select a proper solvent that can dissolve or disperse the dye in a concentration equal to or more than a predetermined level and well dissolve or disperse said binder resin. The solvent is used in an amount of preferably about 9 to about 20 times as much as the total weight of said dye and said binder resin.

The dyes to be used in the present invention may be used alone or as a mixture of two or more of them. In addition, the dyes to be used in the present invention may be mixed with known dyes.

The dyes to be used in the present invention may be used together with known discoloration inhibitors.

As a support to be used for constituting the thermal transfer dye-providing material of the present invention, any known one that has a heat resistance and a strength to some extent may be used. For example, there are illustrated paper having a thickness of about 0.5 μm to about 50 μm, preferably about 3 to about 10 μm, various converted papers, polyesters (e.g., polyethylene terephthalate), polyamides, polycarbonates, glassine paper, condenser paper, cellulose esters, fluorine-containing polymers, polyethers, polyacetals, polyolefins, polyimides, polyphenylene sulfide, polypropylene, polystyrene, cellophane, and polyimide. Of these, polyester film is particularly preferred.

The ink can be coated on a base film using, for example, reverse-roll coaters, gravure coaters, microgravure coaters, rod coaters or air doctor coaters.

As is described above, the thermal transfer dye-providing material is useful as such in the present invention. In addition, an anti-blocking layer, or a release layer, may be provided on the surface of the dye-carrying layer. Such release layer serves to prevent the thermal transfer dye-providing material and the thermal transfer image-receiving material from adhering to each other and permits one to employ a higher thermal transfer temperature to form an image with much better density.

In order to attain the above-described effect of such release layer, mere deposition of an anti-blocking, inorganic powder on the surface is effective to a considerable extent. Further, a release layer may be formed by providing a release layer having a thickness of 0.01 to 5 μm, preferably 0.05 to 2 μm, and comprising a resin with excellent releasing properties such as a silicone polymer, an acrylic polymer or a fluorinated polymer.

Additionally, sufficient releasing properties may also be attained by incorporating the inorganic powder or the releasing polymer in the dye-carrying layer.

Still further, a heat-resistant layer may be provided on the surface of the thermal transfer dye-providing material for the purpose of preventing detrimental influences by the heat of a thermal head.

A dye-barrier layer composed of a hydrophilic polymer may be used in the dye-providing material between the support and the dye layer, which serves to improve density of transferred dye.

When the thus obtained thermal transfer dye-providing material of the present invention is superposed on a conventionally known thermal transfer image-receiving material and is heated from either side, preferably from the surface side of the thermal transfer dye-providing material, according to an image signal by means of a heating means, for example, a thermal head, the dye in the thermal transfer layer easily migrates at a comparatively low energy to the thermal transfer image-receiving material depending upon magnitude of the applied heat energy to form a color image with excellent distinctness, resolving power and gradation.

In a preferred embodiment of the present invention, the thermal transfer dye-providing material is in a sheet form or in a continuous ribbon or roll form. The thermal transfer dye-providing material of the present invention may have only the layer of the magenta dye of the present invention or may further have a layer of a known yellow dye, a layer of a known cyan dye and, in some cases, a layer of a known black dye in different positions. In a preferred embodiment of the present invention, colorant layers containing yellow, magenta, cyan and, in some cases, black thermally transferrable dyes, respectively, are repeatedly arranged to constitute a thermal transfer dye-providing material.

Full-color recording using this thermal transfer dye-providing material is conducted by, for example, superposing the cyan colorant layer on the thermal transfer image-receiving material, applying a color signal corresponding to cyan to each head element of a thermal head in an amount corresponding to a single scanning line of a picture element to thereby transfer the cyan dye of the colorant layer to the image-receiving layer of a thermal transfer image-receiving material according to the heating pattern thus obtained, repeating this procedure with shifting the thermal transfer dye-providing material and the thermal transfer image-receiving material by a single scanning line distance to transfer a single picture of the cyan dye, then repeatedly conducting, successively, the same procedure as to respective colors of yellow, magenta and, in some cases, black to transfer respective dyes to the same picture. An apparatus for use in this recording is known and is described in, for example, JP-A-62-1585.

The dyes of the present invention may be utilized in thermal transfer dye-providing materials other than the heat-migrating type. That is, in another preferred embodiment of the present invention, the thermal transfer layer of the thermal transfer dye-providing material is a heat-melting transfer layer comprising a dye of the present invention and wax. The thermal transfer dye-providing material of this embodiment is obtained by preparing a thermal transfer layer-forming ink comprising a dye-containing wax and forming a heat-meltable transfer layer on one surface of a specific support as mentioned hereinbefore using the ink. This ink is prepared by using a wax with a proper melting point such as paraffin wax, microcrystalline wax, carnauba wax or a urethane series wax as a binder and dispersing a dye therein. As to the proportion of the used dye and wax, the dye preferably accounts for about 10 to about 65 wt % in the formed heat-meltable transfer layer. Thickness of the transfer layer is preferably about 1.5 to about 6.0 μm. Preparation of the ink and application thereof onto the support may be conducted according to known techniques.

When the thermal transfer dye-providing material of the second preferred embodiment of the present invention is used in the same manner as the material of the aforesaid first embodiment, the heat-meltable transfer layer is transferred to the thermal transfer image-receiving material to give excellent printed characters.

Since the dyes of the present invention represented by the foregoing general formula (I) have a distinct magenta color, they are suited for attaining full-color recording with good color reproducibility by combining them with proper cyan dyes and yellow dyes. In addition, they enable recording at high speed and with high color density without applying too much load to a thermal head because of their high sublimatability and large molecular extinction coefficient. Further, since they are stable against heat, light, humidity and chemicals, they are not thermally decomposed during transfer recording, and the recorded images have good preservability. Still further, since the dyes of the present invention have high solubility in organic solvents and high dispersibility in water, it is easy to prepare a highly concentrated ink by uniformly dissolving or dispersing them, and the ink enables one to obtain a thermal transfer dye-providing material wherein the dye is uniformly coated in a high concentration. Hence, recording can be conducted with good uniformity and good color density by using the thermal transfer dye-providing material.

The present invention is now illustrated in greater detail by reference to the following examples which, however, are not to be construed as limiting the present invention in any way.

EXAMPLE 1

Preparation of thermal transfer dye-providing material (1)

A 6 μm thick polyethylene terephthalate film (product of Teijin Limited) whose back surface had been subjected to treatment for imparting heat resistance and lubricating properties was used as a support, and coating composition (1) of the following formulation for forming a thermal transfer dye-providing layer was coated thereon in a dry thickness of 1.5 μm according to wire-bar coating technique to obtain thermal transfer dye-providing material (1).

| Coating composition (1) for forming thermal transfer dye-providing layer: | |
|---|---|
| Dye (No. 1) | 2.5 g |
| Polyvinylbutyral resin (Denka Butyral 5000-A; Product of Electro Chemical Industry Co., Ltd.) | 3 g |
| Toluene | 40 ml |
| Methyl ethyl ketone | 40 ml |
| Polyisocyanate (Takenate D110N, product of Takeda Chemical Industries, Ltd.) | 0.2 ml |

Thermal transfer dye-providing materials (2) to (7) and comparative material (a) shown in Table 1 were prepared in the same manner except for changing the dye.

Preparation of thermal transfer image-receiving material

A 150 μm thick synthetic paper (YUPO-FPG-150, product of Oji-Yuka K.K.) was used as a base, and coating composition (1) of the following formulation for forming an image-receiving layer was coated thereon in a dry thickness of 8 μm according to wire-bar coating technique to form thermal transfer image-receiving material (1). After first drying by means of a drier, it was dried for 30 minutes in a 100° C. oven.

| Coating composition (1) for forming image-receiving layer: | |
|---|---|
| Polyester resin Byron-280, product of Toyo Spinning Co., Ltd.) | 22 g |
| Polyisocyanate (KP-90, product of Dai Nippon Ink & Chemicals, Inc.) | 4 g |
| Amino-modified silicone oil (KF-857, product of Shin-Etsu Silicone K.K.) | 0.5 g |
| Methyl ethyl ketone | 85 ml |
| Toluene | 85 ml |
| Cyclohexanone | 15 ml |

The thermal transfer dye-providing material and the thermal transfer image-receiving material were superposed on each other with the thermal transfer dye-providing layer in contact with the image-receiving layer, and letter printing was conducted using a thermal head from the support side of the thermal transfer image-receiving material under the conditions of 0.25 W/dot in output of the thermal head, 0.15 to 15 msec in pulse width and 6 dots/mm in dot density to image-wise transfer magenta dye onto the image-receiving layer of the thermal transfer image-receiving material. Thus, there was obtained a distinct recorded image with no transfer unevenness.

Reflection spectrum of the recorded thermal transfer image-receiving material was measured by means of a spectrophotometer (product of Hitachi, Ltd.) equipped with an integrating sphere. Distinctness of magenta color image was evaluated in terms of wavelength difference between longer wavelength and shorter wavelength giving a density of ½ of maximum absorption density (as half value width).

Separately, the thus recorded thermal transfer image-receiving material was placed for 7 days in a light fastness tester having a 12,000-lux fluorescent lamp to examine color image stability. Reflection density was measured before and after the test using a status A filter, and light fastness of the samples upon being stored under bright condition was evaluated in terms of the ratio of the reflection density after the test to that before the test.

TABLE 1

| No. | Dye No. | Remarks | Half Value Width (nm) | Transfer Density | Light Fastness |
|---|---|---|---|---|---|
| 1 | 1 | Present Invention | 110 | 1.50 | 0.83 |
| 2 | 2 | Present Invention | 100 | 1.45 | 0.92 |
| 3 | 3 | Present Invention | 100 | 1.30 | 0.89 |
| 4 | 5 | Present Invention | 100 | 1.55 | 0.84 |
| 5 | 6 | Present Invention | 100 | 1.50 | 0.80 |
| 6 | 9 | Present Invention | 100 | 1.50 | 0.90 |
| 7 | 21 | Present Invention | 105 | 1.45 | 0.75 |
| a | Comparative Dye (a) | Comparative Example | 155 | 1.20 | 0.70 |

(a)

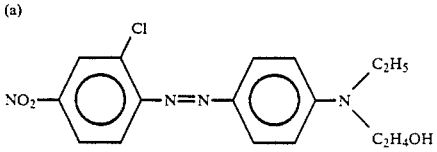

It is apparent from the above results that the dyes used in the present invention are superior to dye (a) of the Comparative Example in sharpness of absorption, color reproducibility and light fastness.

EXAMPLE 2

Thermal transfer dye-providing materials (8 to 10) were prepared in the same manner as in Example 1 except for changing polyvinyl butyral resin in the coating composition (1) of thermal transfer dye-providing layer to a resin and using a dye both as shown in Table 2.

When letter printing was conducted using the same image-receiving material as used in Example 1, there was attained distinct image recording with no transfer unevenness. Light fastness of the resulting image was also found to be excellent.

TABLE 2

| No. | Resin | Dye No. | Transfer Density | Half Valve Width (nm) | Light Fastness |
|---|---|---|---|---|---|
| 8 | Ethylcellulose | 1 | 1.55 | 110 | 0.85 |
| 9 | Cellulose acetate butyrate | 3 | 1.35 | 100 | 0.90 |
| 10 | Polysulfone | 2 | 1.45 | 100 | 0.93 |

EXAMPLE 3

Preparation of thermal transfer image-receiving material

A 150 μm thick synthetic paper (YUPO-FPG-150, product of Oji-Yuka K.K.) was used as a support, and coating composition (2) of the following formulation for forming an image-receiving layer was coated thereon in a dry thickness of 10 μm according to wire-bar coating technique to form thermal transfer image-receiving material (2). After first drying by means of a drier, it was dried for 30 minutes in a 100° C. oven.

| Coating composition (2) for forming image-receiving layer: | |
|---|---|
| Polyester resin No. 1 | 20 g |
| Amino-modified silicone oil (KF-857, product of Shin-Etsu Silicone K.K.) | 0.5 g |
| Epoxy-modified silicone oil (KF-100T, product of Shin-Etsu Silicone K.K.) | 0.5 g |
| Methyl ethyl ketone | 85 ml |
| Toluene | 85 ml |
| Cyclohexanone | 30 ml |

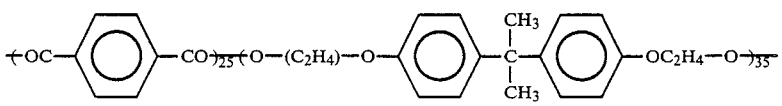

Polyester resin No. 1

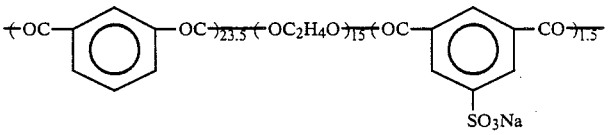

When letter printing was conducted by combining the image-receiving material with the dye-providing material obtained in Example 1 or 2, distinct image recording was attained. Light fastness of the thus formed images were also found to be excellent.

EXAMPLE 4

Preparation of thermal transfer image-receiving material (3)

A resin-coated paper comprising 200 μm thick paper having laminated on both sides thereof 15 μm and 25 μm thick layers of polyethylene, respectively, was prepared, and a coating composition of the following formulation was coated on the 15 μm thick laminated surface in a dry thickness of 10 μm according to wire-bar coating technique and dried to prepare thermal transfer image-receiving material (3).

| Coating composition for forming image-forming layer: | |
|---|---|
| Polyester resin No. 1 | 25 g |
| Amino-modified silicone oil (KF-857, product of Shin-Etsu Silicone K. K.) | 0.8 g |
| Polyisocyanate (KP-90, product of Dai Nippon Ink & Chemicals, Inc.) | 4 g |
| Methyl ethyl ketone | 100 ml |
| Toluene | 100 ml |

When letter printing was conducted in the same manner as in Example 3, image recording with high distinctness and high light fastness was attained.

While the invention has been described in detail and with reference to specific embodiments thereof, it will be apparent to one skilled in the art that various changes and modifications can be made therein without departing from the spirit and scope thereof.

What is claimed is:

1. A thermal transfer dye-providing material, which comprises a support having provided thereon a colorant layer, said colorant layer containing a binder and a dye represented by the following general formula (I):

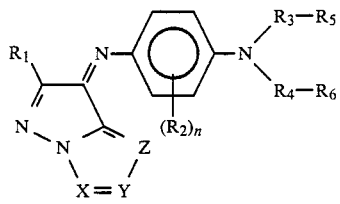

(I)

wherein $R_1$ and $R_2$ each represents a hydrogen atom, a halogen atom, an alkyl group, a cycloalkyl group, an alkoxy group, an aryl group, an aryloxy group, an aralkyl group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group or an amino group, $R_3$ and $R_4$ each represents an alkylene group, $R_5$ represents a halogen atom, an alkoxycarbonyl group, an alkoxycarbonyloxy group, a cyano group, an alkoxycarbonylamino group, a ureido group, a carbamoyl group, a sulfonyl group, an acyloxy group or an acyl group, $R_6$ represents a hydrogen atom or $R_5$, n represents 0 or an integer of 1 to 3, and X, Y and Z each represents

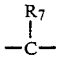

or a nitrogen atom (wherein $R_7$ represents a hydrogen atom, an alkyl group, a cycloalkyl group, an aralkyl group, an aryl group, an alkoxy group, an aryloxy group or an amino group) or, when X and Y, or Y and Z, are

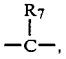

they may be bound to each other to form a sat or unsaturated hydrocarbon ring, with the above-described substituents being optionally further substituted.

2. The thermal transfer dye-providing material of claim 1, wherein $R_1$ is selected from the group consisting of an alkyl group containing up to 8 carbon atoms, an alkoxy group containing up to 8 carbon atoms, and an aryl group containing 6 to 12 carbon atoms.

3. The thermal transfer dye-providing material of claim 1, wherein $R_2$ is selected from the group consisting of a hydrogen atom, an alkyl group containing up to 4 carbon atoms, an alkoxy group containing up to 4 carbon atoms, a halogen atom, an acylamino group containing up to 7 carbon atoms and an alkoxycarbonylamino group containing up to 7 carbon atoms, with $R_2$ being in an o-position with respect to the azomethine bond and n equals 1.

4. The thermal transfer dye-providing material of claim 1, wherein $R_5$ is selected from the group consisting of a cyano group, a sulfonyl group, an alkoxycarbonyl group containing 2 to 5 carbon atoms, and an acyloxycarbonyl group containing 2 to 5 carbon atoms.

5. The thermal transfer dye-providing material of claim 1, wherein $R_6$ represents a hydrogen atoms.

6. The thermal transfer dye-providing material of claim 1, wherein at least one of X, Y and Z represent a nitrogen atom.

7. The thermal transfer dye-providing material of claim 1, wherein at least two of X, Y and Z represent nitrogen atoms.

8. The thermal transfer dye-providing material of claim 1, wherein said binder layer comprises a binder resin.

9. The thermal transfer dye-providing material of claim 1, wherein said binder layer comprises a wax.

* * * * *